United States Patent [19]

Csontos et al.

[11] Patent Number: 4,485,009

[45] Date of Patent: Nov. 27, 1984

[54] GRANULATION RECOVERY DEVICE AND METHOD

[75] Inventors: Steve L. Csontos, North Brunswick; Charles L. Chamberlain, Metuchen, both of N.J.

[73] Assignee: Ortho Pharmaceutical Corporation, Raritan, N.J.

[21] Appl. No.: 458,604

[22] Filed: Jan. 17, 1983

[51] Int. Cl.[3] ..... B07B 9/00

[52] U.S. Cl. ..... 209/37; 209/250; 209/315; 209/379

[58] Field of Search ..... 209/31, 37, 250, 381, 209/315, 373, 379

[56] References Cited

U.S. PATENT DOCUMENTS

| | | | |
|---|---|---|---|
| 672,299 | 4/1901 | Thompson | 209/37 |
| 749,280 | 1/1904 | Emerson | 209/250 |
| 1,095,037 | 4/1914 | Singer | 209/373 |
| 1,134,022 | 3/1915 | Spencer | 209/37 |
| 1,695,383 | 12/1928 | McCarthy | 209/37 |
| 2,721,656 | 10/1955 | Goodwin | 209/36 |
| 3,494,460 | 2/1970 | Scott | 209/379 |
| 4,344,843 | 8/1982 | Leifeld | 209/250 |

FOREIGN PATENT DOCUMENTS

| | | | |
|---|---|---|---|
| 560144 | 4/1957 | Italy | 209/250 |

*Primary Examiner*—Tim Miles

*Attorney, Agent, or Firm*—Benjamin F. Lambert

[57] ABSTRACT

A granulation recovery device comprising a vacuum head, a canister removably attached to said vacuum head and a membrane and a support therefor which act as an interface between the vacuum head and the canister. The canister also contains means for diverting a granulation mixture away from the interface during operation of the device while simultaneously separating granulation from the granulation mixture. In operation, the device is attached to an exterior source of granulation loss.

12 Claims, 4 Drawing Figures

10
8
2
1
6
3
2
4
2
7
9
5
11

GRANULATION RECOVERY DEVICE AND METHOD

The present invention relates to a device for recovering granulation from a granulation mixture which is lost during the formation of solid dosage forms of medicaments such as tablets, capsules and the like.

In the preparation of solid dosage forms of medicinal substances, granulations of the substances are generally employed. During this process, however, a certain amount of granulation is lost and becomes mixed with fragments of other materials used to prepare the solid dosage form thus rendering it unsuitable for further use in the procedure. For economic reasons, it would be advantageous to be able to capture this mixture and separate and purify the granulation from the mixture for reuse. Felt or paper filters have been employed to capture the lost granulation mixture, however, in those cases where the granulation mixture is comprised of particles which differ in size, there is a tendency for the smaller particles to pass through or become permanently entrapped in the filter preferentially. This results in a change in the composition of the granulation which renders the recovered granulation unsuitable for reuse. The device of the present invention provides a means of capturing a granulation mixture normally lost during the preparation of solid dosage forms of medicaments in such a way as to not alter the composition, purity or activity of the recovered granulation.

SUMMARY OF THE INVENTION

The granulation recovery device of the present invention comprises a vacuum head assembly, a canister which is attached to the vacuum head, and a membrane and support therefor which together form the interface between the vacuum head and the canister. The membrane faces the floor of the canister. In addition, the canister contains a means for diverting the granulation mixture away from the interface during operation of the device. The diverting means is preferably installed between the membrane and the floor of the canister and at least one of its sides is comprised of a screen.

In a preferred embodiment of the invention, a contracting means such as a plastic or metal spring or the like is placed between the membrane interface and the vacuum head assembly.

In operation the device is attached to a source of granulation loss from an apparatus such as a capsule or tablet making machine. When vacuum is applied to the vacuum head assembly, air is drawn through the membrane creating a vacuum in the canister. The vacuum causes air, granulation and capsule fragments, etc. to be transported at high velocity into the canister. Upon entering the canister, the mixture of air, granulation and fragments first enters the granulation diverter which separates the granulation from the solid fragments by allowing the granulation to fall to the floor of the canister through the screen in the diverter. Both air and granulation pass through the screen into the canister. The resultant increase in the cross-sectional area in the canister causes a significant reduction in air velocity. This effect, in conjunction with the diverter directing the incoming stream to the bottom of the canister, minimizes the amount of granulation that can be carried with the air stream toward the membrane. The air then passes freely through the membrane into the vacuum head assembly, while any granulation which is light enough to travel with the air is captured on the surface of the membrane. The membrane acts as a barrier rather than a filter and granulation is captured at the surface instead of becoming trapped inside a filter. When the vacuum is turned on, the membrane and its support or backing are drawn upward compressing the contracting means in the vacuum head assembly. When the vacuum is turned off, the contracting means expands vigorously causing the membrane and its support to return to their original position. Any granulation which adhered to the membrane during the recovery procedure is dislodged by the vigorous downward motion imparted to the membrane by the contracting means and falls to the floor of the canister. The vacuum applied to the system is low enough so as not to stir up the granulation resting on the floor of the canister but still strong enough to transport the granulation mixture from the source of granulation loss into the granulation diverter. The actual vacuum applied will depend upon the size of the canister and vacuum head employed. After the recovery operation is complete, the canister is disconnected from the granulation source and the recovered material is removed from the canister.

Figure 1:
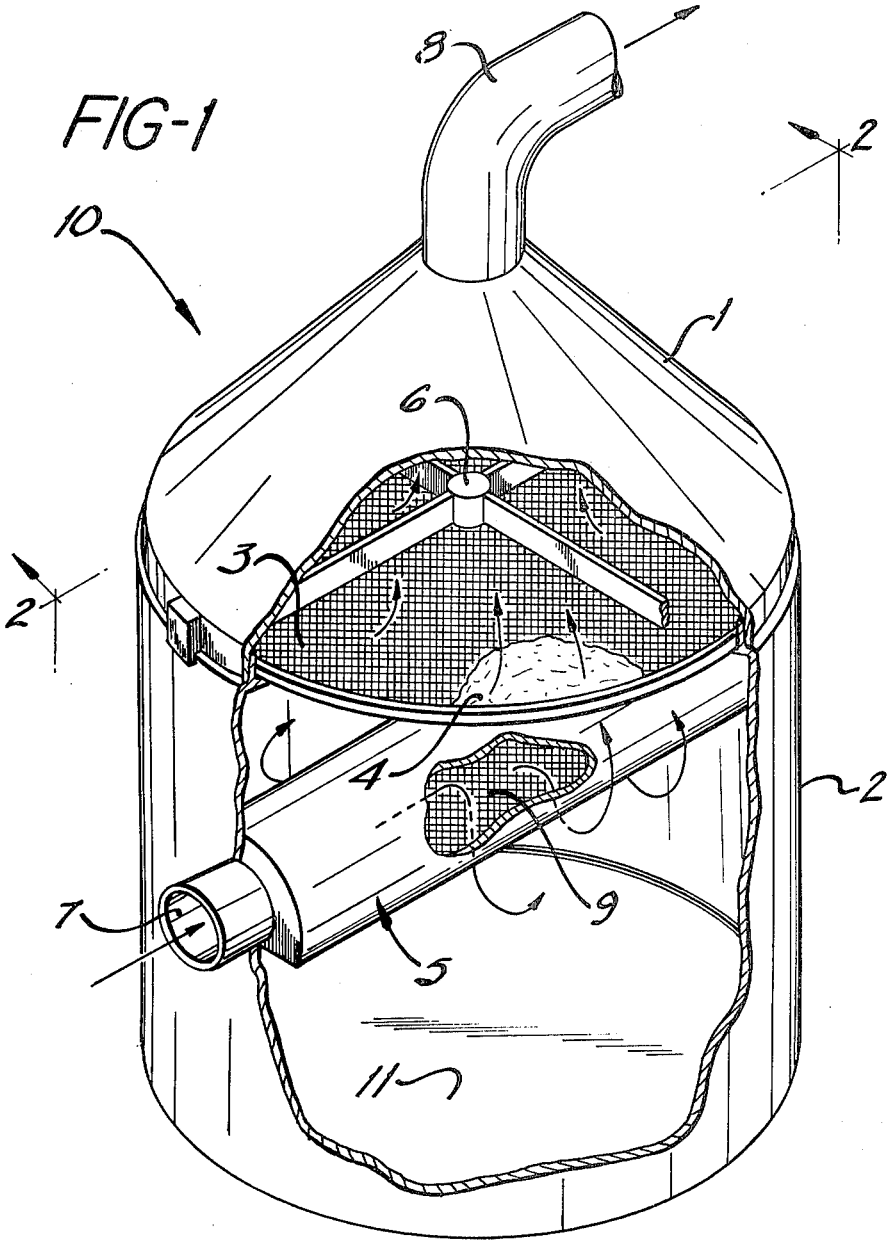
FIG. 1 is a perspective view partially broken away showing the inner cavity of the recovery device.

The vacuum head assembly and the canister are made from any suitable metal or hard plastic material. The preferred material is stainless steel. The dimensions of the canister and vacuum head assembly will depend upon the amount of granulation to be recovered. The membrane is preferably made from a porous material which will not allow the granulation to penetrate or stick to its surface but will allow the free passage of air. The material employed is preferably an inert material which will not react with or contaminate the product. Any flexible metal or plastic material may be employed to prepare the membrane. A thin sheet of a scintered metal or scintered glass are among the materials which can be employed. The preferred material, however, is polytetrafluoroethylene, commonly known as Teflon.

Any suitable means can be employed to support the membrane. For example, the membrane can be attached to a set of crossbars which in turn are attached to the walls of the vacuum head assembly. The contracting means can be conveniently housed in the mode of the crossbars. Instead of the crossbars, a flexible porous material such as commonly used plastics or metals may be employed as a backing or support for the membrane. The backing and membrane are then designed to fit evenly and firmly between the canister and the vacuum head assembly but so as to be removable. The preferred backing is a flexible, metal screen such as a stainless steel screen which has the advantage that it will contract while the system is under vacuum. When the vacuum is released, the screen and membrane will snap back to their original shape, causing any adhered granulation to fall to the floor of the canister. When a flexible material such as a metal screen is employed as the backing, the use of the contracting means is optional. However, any backing that is employed in conjunction with the membrane must be porous enough to allow air to flow freely through it while the system is under vacuum.

The granulation converter can be made from any suitable metal or plastic material. The preferred material is stainless steel.

The contracting means, when employed, is made from any suitable metal or plastic material. Stainless steel is the preferred material.

DETAILED DESCRIPTION

While this invention is satisfied by embodiments in many different forms, there is shown in the drawings and is herein described in detail a preferred embodiment of the invention, with the understanding that the present disclosure is considered to be exemplary of the principles of the invention and is not intended to limit the invention to the embodiment illustrated. The scope of the invention is pointed out in the appended claims.

Figure 2:
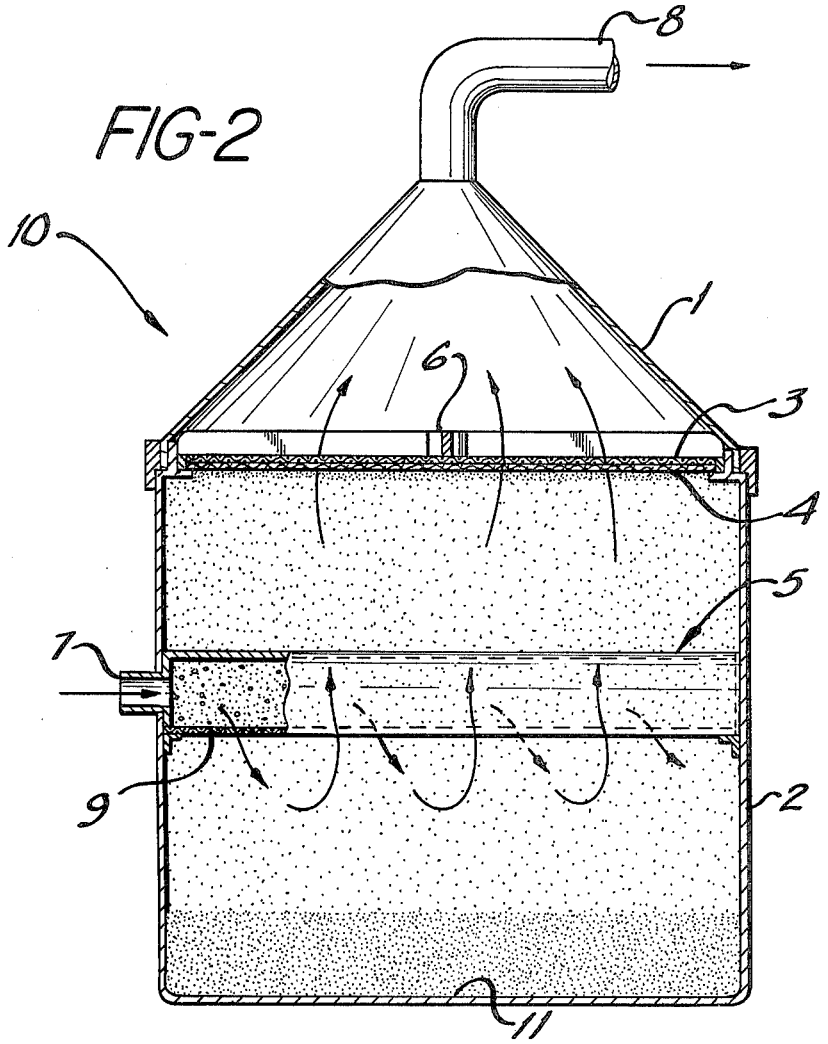
FIG. 2 is cross-sectional view taken along lines 2—2 of FIG. 1.

Turning to the drawings, particularly FIGS. 1 and 2, there is illustrated the preferred embodiment of the present invention. Granulation recovery device 10 is comprised of vacuum head assembly 1, canister 2, support 3, membrane 4, and granulation diverting means 5.

Figure 3:
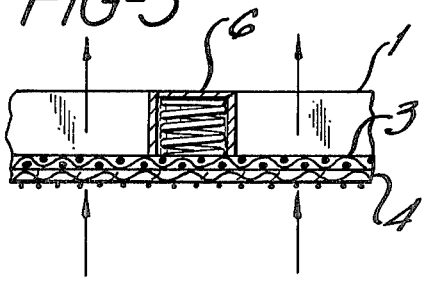
FIG. 3 is an enlarged detail view partially in section showing the contracting means in its compressed position.
Figure 3A:
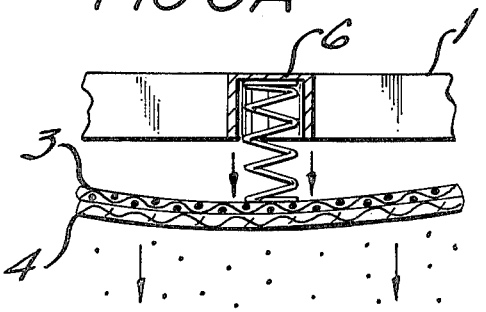
FIG. 3A is an enlarged detail view partially in section showing the contracting means in its at rest position.

Vacuum head assembly 1 is preferably conical in shape although any convenient shape may be employed. Canister 2 is preferably cylindrical in shape but other shapes may be employed in which the granulation may be conveniently recovered. Support or backing 3 and membrane 4 are mounted between the vacuum head assembly 1 and the canister 2 so as to be easily removable. Membrane 4 is mounted in the device horizontally above the canister facing downward. This configuration prevents granulation build-up on the membrane surface. Granulation diverting means 5 is removably attached to one or both sides of the canister and is comprised of a housing having a screen 9 on at least one of its sides, preferably the bottom side, and one inlet 7 which can be connected directly to the source of granulation loss. Contracting means 6, when employed, is placed above the membrane and support 3, preferably in the center of vacuum head assembly 1. Support 3 and membrane 4 are drawn upward compressing contracting means 6 when vacuum is applied through outlet 8 in vacuum head assembly 1 and return to their rest position when the vacuum is released. Use of the contracting means to dislodge captured granulation from the membrane is shown in FIGS. 3 and 3A.

The overall configuration of the device creates high air velocity in the connection between the canister and the source of granulation loss while at the same time creating a low air velocity in the canister, thus minimizing the amount of suspended granulation.

Thus there has been provided a granulation recovery device which makes it possible to recover and reuse dry granulation from a granulation mixture comprised of ingredients of different particle size.

We claim:

1. A device for recovering granulation from a granulation mixture comprising a vacuum head assembly having an aperture at one end for attachment to a source of vacuum, a canister removably attached to said vacuum head assembly and a screen and a membrane which are detachably joined to said recovery device so as to form an interface between said vacuum head assembly and said canister, said canister containing means for diverting said granulation mixture away from said interface during operation while separating said granulation from said mixture and said means additionally containing an aperture for attachment to a source of granulation loss.

2. The device of claim 1 which additionally includes in the vacuum head assembly means for contracting and expanding the screen and membrane during operation.

3. The device of claim 1 wherein the contracting means is a spring.

4. The device of claim 1 wherein the diverting means contains a screen on the side facing the floor of the canister.

5. The device of claim 1 wherein the membrane is comprised of polytetrafluoroethylene.

6. The device of claim 1 wherein the vacuum head assembly is conical in shape and the canister is cylindrical in shape.

7. A device for recovering granulation from a granulation mixture comprising a vacuum head assembly having an aperture at one end for attachment to a source of vacuum, a canister removably attached to said vacuum head assembly and a membrane and support therefor detachably joined to said recovery device so as to form an interface between said vacuum head assembly and said canister, said canister containing means for diverting said granulation mixture away from said interface during operation, while separating said granulation from said mixture and said means additionally containing an aperture at one end for attachment to a source of granulation loss.

8. The device of claim 7 which additionally includes means for contracting and expanding the membrane and its support.

9. The device of claim 7 wherein the membrane is comprised of polytetrafluoroethylene.

10. The device of claim 7 wherein the vacuum head assembly is conical in shape and the canister is cylindrical in shape.

11. The device of claim 7 wherein the contracting means is a stainless steel spring.

12. A method of recovering granulation from a granulation mixture which comprises directing a granulation mixture obtained from a source of granulation loss into a canister provided with a granulation diverting means for separating granulation from the granulation mixture, a vacuum head assembly and a membrane at the interface between the canister and the vacuum head assembly located above said diverting means, and applying vacuum to the system whereby air and granulation pass through the granulation diverting means allowing granulation to collect on the floor of said canister while the air and granulation light enough to be carried along with the air are drawn upwards toward the vacuum source through the membrane, said membrane being capable of trapping said light granulation on its surface.

* * * * *